United States Patent [19]

Whitton, Jr. et al.

[11] 3,967,329

[45] July 6, 1976

[54] INVALID LIFTING DEVICE

[76] Inventors: Robert E. Whitton, Jr., 5155 Thirteen Mile Road, Warren, Mich. 48092; Harold M. Stith, 16559 Ohio, Detroit, Mich. 48221

[22] Filed: Apr. 24, 1975

[21] Appl. No.: 571,418

[52] U.S. Cl. ..... 5/92; 5/81 R; 297/DIG. 10

[51] Int. Cl.[2] ..... A61G 1/02

[58] Field of Search ..... 5/1, 81 R, 86, 92, 317; 248/118, 214; 297/DIG. 10, 427; 272/1 R, 57 R; 35/29 R

[56] References Cited

UNITED STATES PATENTS

| | | | |
|---|---|---|---|
| 46,365 | 2/1865 | Kinman | 248/118 |
| 3,041,636 | 7/1962 | Twedt | 5/81 R |
| 3,508,359 | 4/1970 | Jernstrom | 272/57 R |
| 3,591,874 | 7/1971 | O'Kennedy | 5/92 |

*Primary Examiner*—Casmir A. Nunberg
*Attorney, Agent, or Firm*—Fisher, Gerhardt & Groh

[57] ABSTRACT

A device for aiding a standing person in the raising of a seated person to a standing position has a first portion with an opening to receive and encompass the leg of the standing person and a second portion with a opening to receive a knee of the seated person so that such knee is held in a fixed position relative to the leg of the standing person while the seated person is pulled forward and upward to a standing position.

5 Claims, 6 Drawing Figures

INVALID LIFTING DEVICE

This invention relates to means to aid in raising or lifting invalid persons and more particularly to devices for aiding one standing person in lifting a seated person from a seated position to a standing position.

When incapacitated or invalid persons such as a hospital patient, are well enough to sit in a chair and to stand they may still require help to stand up, particularly in order to engage in physiotherapy or the like. This usually requires a relatively large or strong person to bodily lift the patient from the sitting to standing position. This lifting can result in excess strain on the back of the person aiding the patient to rise, especially since the helping person must bend forward into a position over the patient.

Where the person doing the lifting, such as a medical aide, therapist, nurse etc., is small in size relative to the size of the patient, the problem is accentuated. Furthermore, the patient himself can have a strain placed on his or her body or members during the conventional lifting or pulling to a standing position.

It is therefore an object of the present invention to provide means wherein a relatively small person can easily lift a larger person without excess strain.

It is a further object to provide means in the form of a device that enables a standing person to hold the lower leg of a seated person from moving forward while he is at the same time pulling and lifting the seated person toward himself.

A still further object is to provide a device that can be attached to the leg of a standing person and to the knee of a seated person to prevent the knee from moving forward while the standing person pulls and lifts the invalid person upward and forward toward a standing position.

These and other objects and advantages will be readily apparant from the following description and accompanying drawings in which.

Figure 1:
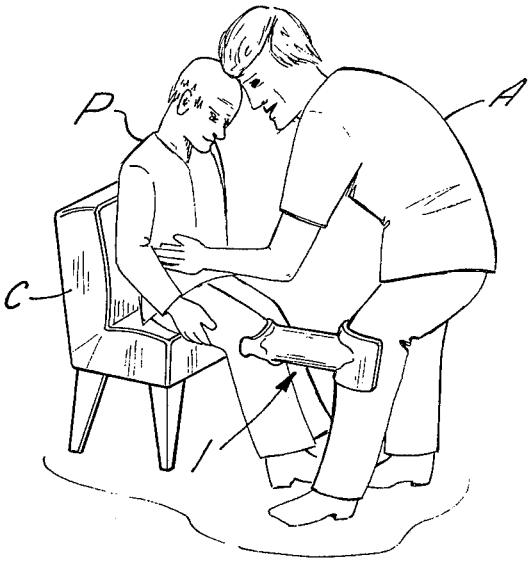
FIG. 1 is a perspective view showing the invention being used.

Referring now to the figures in which a preferred embodiment of the invention is shown and in which FIG. 1 shows a device being used by an aide A while pulling and lifting a patient P who is in a seated position on a chair C.

Figure 2:
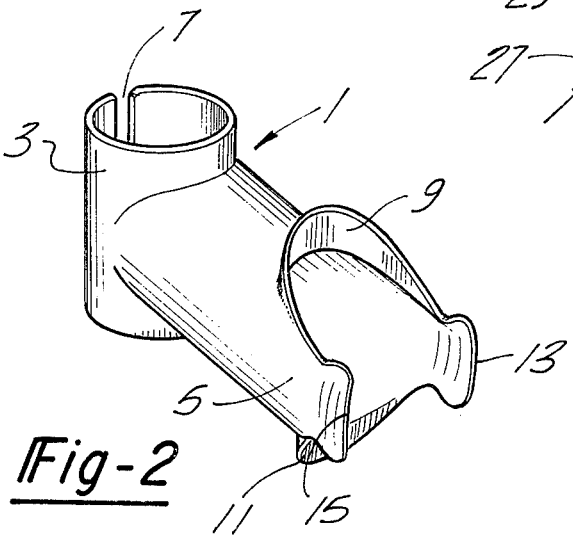
FIG. 2 is a perspective view of the device taken from one side and end.
Figure 3:
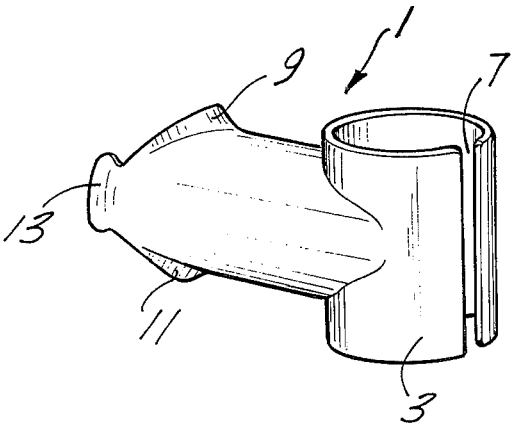
FIG. 3 is another perspective view of the device taken from a different side and end.
Figure 4:
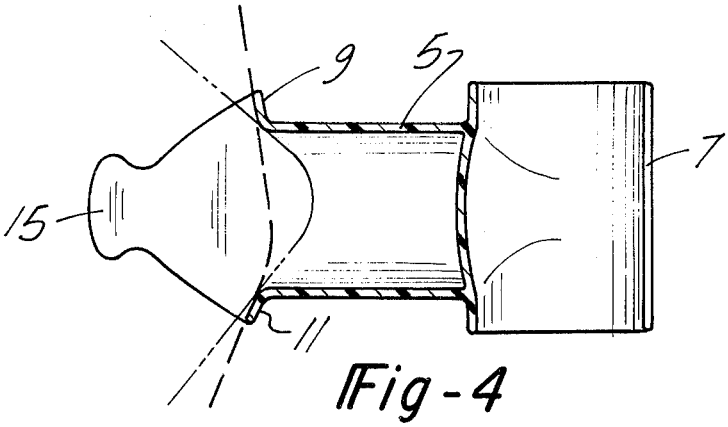
FIG. 4 is a vertical sectional view taken through the center of the device.

As seen in FIGS. 2, 3 and 4, the invention comprises a device, generally indicated 1, that includes a first vertically extending hollow cylindrical part 3 having a vertical slot 7 formed therein permitting the walls of the part 3 to be flexed and receive the knee and leg of the aide A, as in FIG. 1. The device 1 is constructed of any suitable material that is at the same time relatively strong and yet flexible enough to, as stated above, be opened to receive the leg and knee of a person. Suitable materials would be high strength plastics that can be molded or otherwise formed to the size and shape desired. The choice of material itself forms no part of the invention.

The device further includes a second cylindrical part 5 that extends at right angles or horizontally as shown from the first part 3. The portions 3 and 5 can be molded together in one piece or separate pieces that are suitably attached. They can also be formed by rolling sheets into the cylindrical form.

As seen in the figures, the upper and lower edges of the outer end of the part 5 is recessed back so as to receive the leg and knee of the patient. Flanges 9 and 11 are formed at the edge of the relieved portions. The flanges, as seen in FIG. 4, extend upward and downward at an angle from the surface of the part 5. These flanges 9 and 11 act to contact the leg of the patient above and below the knee over an extended area. The flanges thus distribute the force of the device pressing against the patient and hence reduce the likelihood of pain on the leg. A cushioning means, such as a towel, can also be placed over the patient's leg to further reduce the pressure on his or her leg.

The purpose of forming the flanges 9 and 11 at an acute angle is so the flanges will engage and effect a force against the leg of the patient without excessive reverse bending or causing hyperflexure of the knee, that is bending of the leg at the knee beyond its normally straight position. As seen in FIG. 4 the leg of the patient is still slightly bent when the patient is in a standing position.

The outer ends of the lateral sides of horizontal part 5 between the relieved portions form flexible tabs 13 and 15 that serve to embrace the patient's knee and act to keep the device from slipping off the knee.

Figure 5:
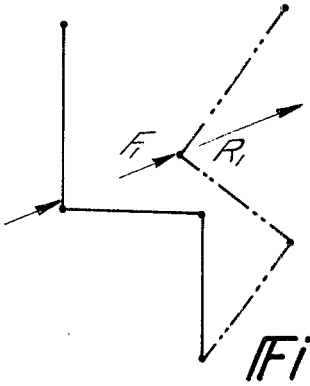
FIG. 5 is a schematic view showing the effect of pulling on a seated person without using the invention.

FIG. 5 schematically illustrates what normally happens when a seated person is pulled upward and forward without the use of the invention. The force R, resulting from a force F applied above or near the hip 27 is mainly forward and the patient tends to fall forward. Thus, in order to raise to a standing position, the patient's weight must be bodily lifted upward requiring considerable strength and possibly resulting in back strain of the lifting person.

Figure 6:
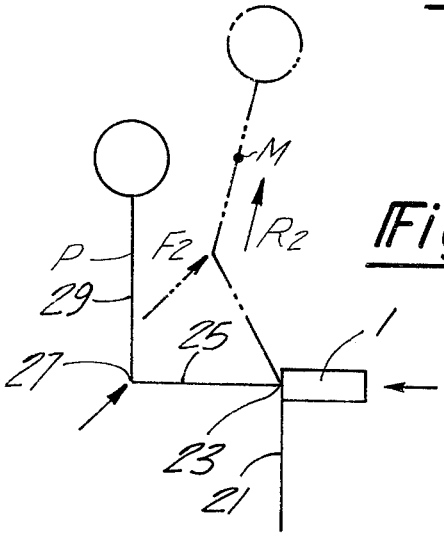
FIG. 6 is a second schematic view showing the result obtained by using the invention while pulling on the seated person.

FIG. 6 illustrates the effect of a similar force F2 applied at or near the patient's hip 27 with the device 1 serving to prevent forward movement of the knee 23 and lower leg 21. The upper leg 25 and torso 29 pivotally connected together at hip 27, act as a toggle linkage with the resultant force R2 acting upward to cause the center of mass of the upper part of the patient's body to raise up and straighten out and thereby cause the patient to assume a raised standing position. The invention 1 serves a dual purpose; that of preventing the patient's knee from moving forward as in FIG. 5, and also acting as a fulcrum point for swinging the weight of the seated person forward.

The cylindrical parts 3 and 5 could be adjustably connected such as by a pivot connection instead of being integral in order to provide for limited range of movement of part 5 relative to part 3 so that the height of the knee receiving part of portion 5 could be varied relative to the leg receiving portion of part 3 to accommodate different knee heights of aides and patients. The parts 3 and 5 could also be varied to accommodate other differences in use.

The device can also be used to aid in manipulating the invalid person around after standing up. Also the device can be used to allow the patient to sit down after standing with a controlled movement without a sudden fall into a chair which might cause injury.

It will be obvious to those skilled in the art that the invention could be made in various forms and shapes and by various manufacturing steps. Such modifications are deemed to be within the scope of the invention which is limited only by the following claims:

We claim:

1. A device for aiding a first person in raising a second person from a seated position to a standing position, said device including a first part shaped to conform to and adapted to be attached to and carried by a knee of the first person and a second part shaped to conform to and adapted to attach to the knee of the second person whereby a fixed spaced relationship between the knees of the two persons is maintained while the first person moves the upper part of the second person from a bent seated position to a straight standing position.

2. The device of claim 1 wherein the first part comprises a cylindrical shaped member formed to receive and partially surround and be carried by the knee of the first person and the second part comprises a curved member adapted to fit around the knee of the second person whereby the knee of the second person is prevented from moving forward toward the first person as the first person pulls the second person forward from the bent seated position to the straight standing position.

3. The device of claim 1 wherein the first part comprises a vertically extending flexible cylindrical member having a vertical slot adapted to be enlarged by flexing of the member to thereby receive the leg of the first person and the second part comprises a cylindrical member horizontally extending member and having the upper and lower end portions recessed to receive the knee of the second person.

4. The device of claim 3 wherein the horizontally extending member has upwardly and downwardly extending flanges at the edge of the recessed portions to present spaced flat surfaces adapted to engage the second person's upper leg above the knee, and lower leg below the knee.

5. The device of claim 4 wherein the flanges extend from the horizontally extending member at an angle so that they contact the second persons leg over an extended area when such leg is in a slightly bent position.

* * * * *